US005944313A

United States Patent [19]

Hockley

[11] Patent Number: 5,944,313

[45] Date of Patent: Aug. 31, 1999

[54] GAME OF IDENTIFYING MUSIC FROM TELEVISION SHOWS

[76] Inventor: Barry J. Hockley, 339 Jeremy Dr., Hanover, Pa. 17331

[21] Appl. No.: 09/010,752

[22] Filed: Jan. 22, 1998

[51] Int. Cl.[6] ..... A63F 3/00

[52] U.S. Cl. ..... 273/249

[58] Field of Search ..... 273/242, 243, 273/248, 249

[56] References Cited

U.S. PATENT DOCUMENTS

| | | | |
|---|---|---|---|
| 4,787,639 | 11/1988 | Ross | 273/249 |
| 4,998,736 | 3/1991 | Elrod | 273/249 |
| 5,277,429 | 1/1994 | Smith, III | 273/249 X |
| 5,316,308 | 5/1994 | Stembokas | 273/249 |
| 5,679,002 | 10/1997 | Scelgo | 273/249 X |

FOREIGN PATENT DOCUMENTS

| | | | |
|---|---|---|---|
| 2219217 | 12/1989 | United Kingdom | 273/249 |

*Primary Examiner*—William E. Stoll

[57] ABSTRACT

A new game of identifying music from television shows for providing a game that requires identification of television theme songs. The inventive device includes a playing board having a path of travel defined thereon. The path of travel includes a starting point and a finishing point. A playing die is provided. A plurality of playing pieces are provided with each having a distinguishable shape. A plurality of cassettes are provided with each having theme songs from television shows thereon. A book of bonus questions related to television shows are provided.

2 Claims, 2 Drawing Sheets

GAME OF IDENTIFYING MUSIC FROM TELEVISION SHOWS

BACKGROUND OF THE INVENTION

1. Field of the Invention

The present invention relates to board games and more particularly pertains to a new game of identifying music from television shows for providing a game that requires identification of television theme songs.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 4,871,176 to Knetzger; U.S. Pat. No. 5,433,449 to Sowek; U.S. Pat. No. 5,121,928 to Salerno-Sonneberg; U.S. Pat. No. Des. 358,851 to Johnson et al.; U.S. Pat. No. 4,907,808 to Turner et al.; and U.S. Pat. No. 5,248,147 to Smith.

While these devices fulfill their respective, particular objectives and requirements, the aforementioned patents do not disclose a new game of identifying music from television shows. The inventive device includes a playing board having a path of travel defined thereon. The path of travel includes a starting point and a finishing point. A playing die is provided. A plurality of playing pieces are provided with each having a distinguishable shape. A plurality of cassettes are provided with each having theme songs from television shows thereon. A book of bonus questions related to television shows are provided.

In these respects, the game of identifying music from television shows according to the present invention substantially departs from the conventional concepts and designs of the prior art, and in so doing provides an apparatus primarily developed for the purpose of providing a game that requires identification of television theme songs.

SUMMARY OF THE INVENTION

In view of the foregoing disadvantages inherent in the known types of board games now present in the prior art, the present invention provides a new game of identifying music from television shows construction wherein the same can be utilized for providing a game that requires identification of television theme songs.

The general purpose of the present invention, which will be described subsequently in greater detail, is to provide a new game of identifying music from television shows apparatus and method which has many of the advantages of the board games mentioned heretofore and many novel features that result in a new game of identifying music from television shows which is not anticipated, rendered obvious, suggested, or even implied by any of the prior art board games, either alone or in any combination thereof.

To attain this, the present invention generally comprises a playing board having a path of travel defined thereon. The path of travel includes a starting point and a finishing point. A playing die is provided. A plurality of playing pieces are provided with each having a distinguishable shape. A plurality of cassettes are provided with each having theme songs from television shows thereon. A book of bonus questions related to television shows are provided.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game of identifying music from television shows apparatus and method which has many of the advantages of the board games mentioned heretofore and many novel features that result in a new game of identifying music from television shows which is not anticipated, rendered obvious, suggested, or even implied by any of the prior art board games, either alone or in any combination thereof.

It is another object of the present invention to provide a new game of identifying music from television shows which may be easily and efficiently manufactured and marketed.

It is a further object of the present invention to provide a new game of identifying music from television shows which is of a durable and reliable construction.

An even further object of the present invention is to provide a new game of identifying music from television shows which is susceptible of a low cost of manufacture with regard to both materials and labor, and which accordingly is then susceptible of low prices of sale to the consuming public, thereby making such game of identifying music from television shows economically available to the buying public.

Still yet another object of the present invention is to provide a new game of identifying music from television shows which provides in the apparatuses and methods of the prior art some of the advantages thereof, while simultaneously overcoming some of the disadvantages normally associated therewith.

Still another object of the present invention is to provide a new game of identifying music from television shows for providing a game that requires identification of television theme songs.

Yet another object of the present invention is to provide a new game of identifying music from television shows which includes a playing board having a path of travel defined thereon. The path of travel includes a starting point and a finishing point. A playing die is provided. A plurality of playing pieces are provided with each having a distinguishable shape. A plurality of cassettes are provided with each having theme songs from television shows thereon. A book of bonus questions related to television shows are provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
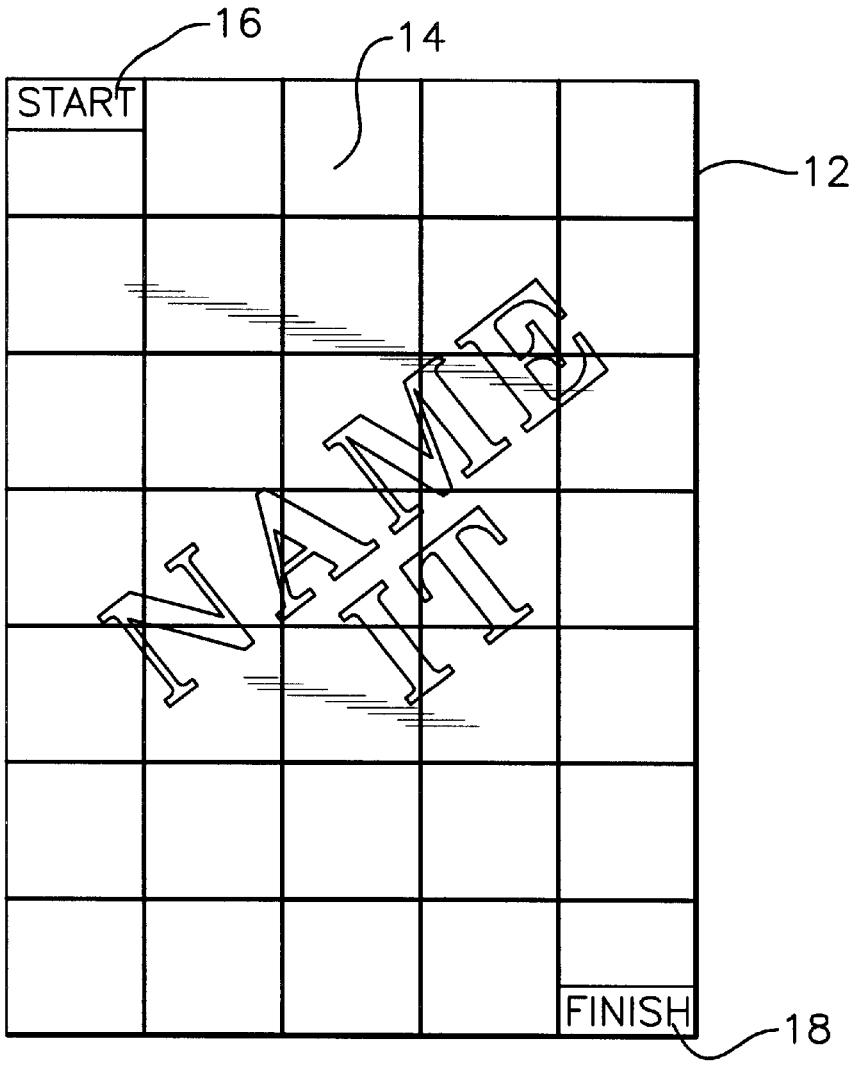
FIG. 1 is a front view of a new game of identifying music from television shows according to the present invention.
Figure 2:
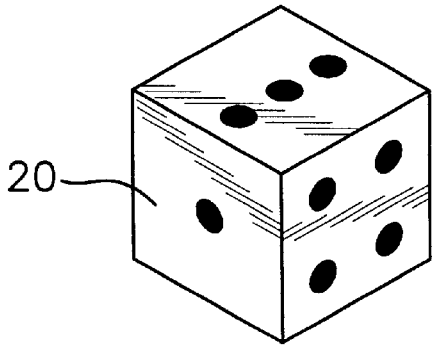
FIG. 2 is a perspective view of the playing die of the present invention.
Figure 3:
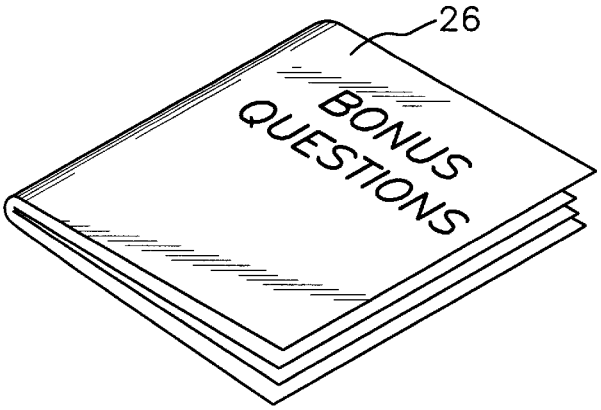
FIG. 3 is a perspective view of the bonus question book of the present invention.
Figure 4:
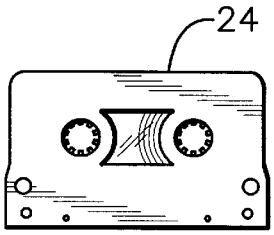
FIG. 4 is a front view of one of the music cassettes of the present invention.

With reference now to the drawings, and in particular to FIGS. 1 through 5 thereof, a new game of identifying music from television shows embodying the principles and concepts of the present invention and generally designated by the reference numeral 10 will be described.

Figure 5:
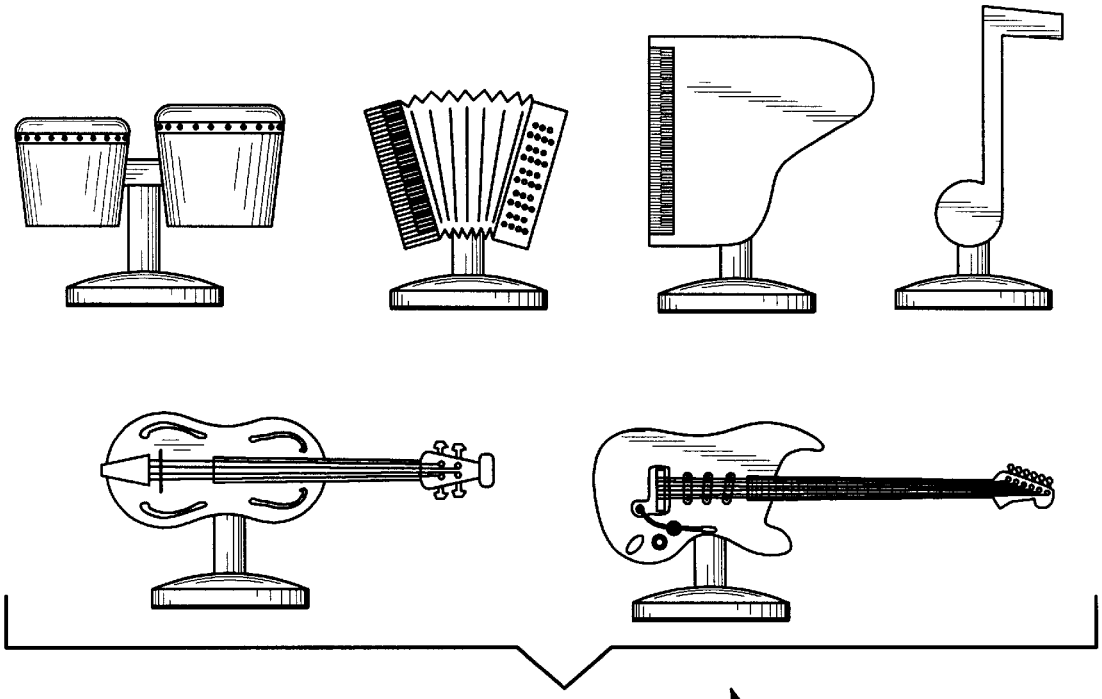
FIG. 5 is a front view of the playing pieces of the present invention.

As best illustrated in FIGS. 1 through 5, the game of identifying music from television shows 10 comprises a playing board 12 having a path of travel 14 defined thereon. The path of travel 14 includes a starting point 16 and a finishing point 18. A playing die 20 is provided. A plurality of playing pieces 22 are provided with each having a distinguishable shape. A plurality of cassettes 24 are provided with each having theme songs from television shows thereon. A book of bonus questions 26 related to television shows are provided. The playing pieces 22, as illustrated in FIG. 5, include shapes of drum, an accordion, a piano, a musical note, a standard guitar and an electrical guitar.

The game starts with the highest roll of the playing die 20 going first. After the first player is chosen, the next players proceed in a clockwise direction. The first player must identify a song from one of the cassettes 24. When the first player is successful, the die 20 is rolled and the player moves the number of spaces indicated on the die 20. The player then has the option of answering a bonus question selected from the book of bonus questions 26. If the bonus question is answered correctly, the player rolls the die 20 again and moves the number of spaces indicated by the die 20. If the player misses the bonus question then he or she moves back the number of spaces indicated by the die 20. The player will continue until such time that they miss a question.

Alternately, different versions could be provided that include sounds or effects from television shows or movies and also a version that includes lines from television shows or movies.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new game of identifying music from television shows for providing a game that requires identification of television theme songs comprising, in combination:

a playing board having a path of travel defined thereon, the path of travel including a starting point and a finishing point;

a playing die;

a plurality of playing pieces each having a distinguishable shape;

a plurality of cassettes each having theme songs from television shows thereon;

a book of bonus questions related to television shows.

2. A method of playing a game of identifying music from television shows comprising, in combination:

providing a playing board having a path of travel defined thereon, the path of travel including a starting point and a finishing point;

providing a playing die;

providing a plurality of playing pieces each having a distinguishable shape;

providing a plurality of cassettes each having theme songs from television shows thereon;

providing a book of bonus questions related to television shows.

* * * * *